United States Patent [19]

Camilleri

[11] 4,071,240

[45] Jan. 31, 1978

[54] LIFTS FOR BALL ELEVATOR

[76] Inventor: Thomas M. Camilleri, 277 Avenue W., Brooklyn, N.Y. 11226

[21] Appl. No.: 642,913

[22] Filed: Dec. 22, 1975

[51] Int. Cl.[2] ..... A63D 5/02

[52] U.S. Cl. ..... 273/49

[58] Field of Search ..... 273/49, 43 E; 4/185 F; 15/215, 216; 206/.8

[56] References Cited

U.S. PATENT DOCUMENTS

| | | | |
|---|---|---|---|
| D. 238,538 | 1/1976 | Smith | 15/215 X |
| 2,477,960 | 8/1949 | Caldwell | 4/185 F X |
| 2,967,708 | 1/1961 | Huck et al. | 273/49 X |
| 3,425,691 | 2/1969 | Lenhart | 273/49 |

FOREIGN PATENT DOCUMENTS

| | | | |
|---|---|---|---|
| 92,935 | 10/1938 | Sweden | 4/185 F |

*Primary Examiner*—Anton O. Oechsle
*Attorney, Agent, or Firm*—D. J. Perrella

[57] ABSTRACT

A lift for a ball elevator wheel for an automatic pinsetting bowling machine is formed of a substantially rectangular strip of flexible elastomeric material with a first bevel in the direction of rotation of the elevator wheel and a second bevel facing the open front of the elevator wheel. At least one and preferably two strips are provided. The strips cover only a minor portion of the inner circumference of the elevator wheel.

8 Claims, 3 Drawing Figures

LIFTS FOR BALL ELEVATOR

BACKGROUND OF THE INVENTION

The present invention relates to the ball return system for one type of automatic pinsetting machine and, more particularly, to the ball elevator which forms part of the system for returning the ball to the bowler.

In one type of automatic pinsetting machine the bowling ball after being thrown by the bowler reaches a pit conveyor at the end of the lane. A ball elevator receives the ball from the pit conveyor and carries it up to the ball return track. When the ball has picked up some of the conditioning oil applied regularly to the lane as a maintenance operation, the ball will not have enough friction to be picked up by the ball elevator. When this happens the ball must be moved manually. This condition delays the game and is a source of annoyance to the bowler and a time-consuming, money-losing incovenience to the management.

OBJECTS OF THE INVENTION

It is an object of the present invention to provide an improved ball elevator. Another object is to provide a ball elevator which is effective for bowling balls which become coated with oil as well as for uncoated bowling balls. A further object is to provide lift means for a ball elevator. Another object is to provide a method for preventing malfunction of the ball elevator. These and other objects of the invention will become apparent from the following description.

SUMMARY OF THE INVENTION

An improved ball elevator for an automatic pinsetting machine is obtained by providing the ball elevator with at least one strip of flexible elastomeric material optionally having a bevel along two adjacent sides and optionally having a plurality of projections on its top surface.

DETAILED DESCRIPTION

Figure 1:
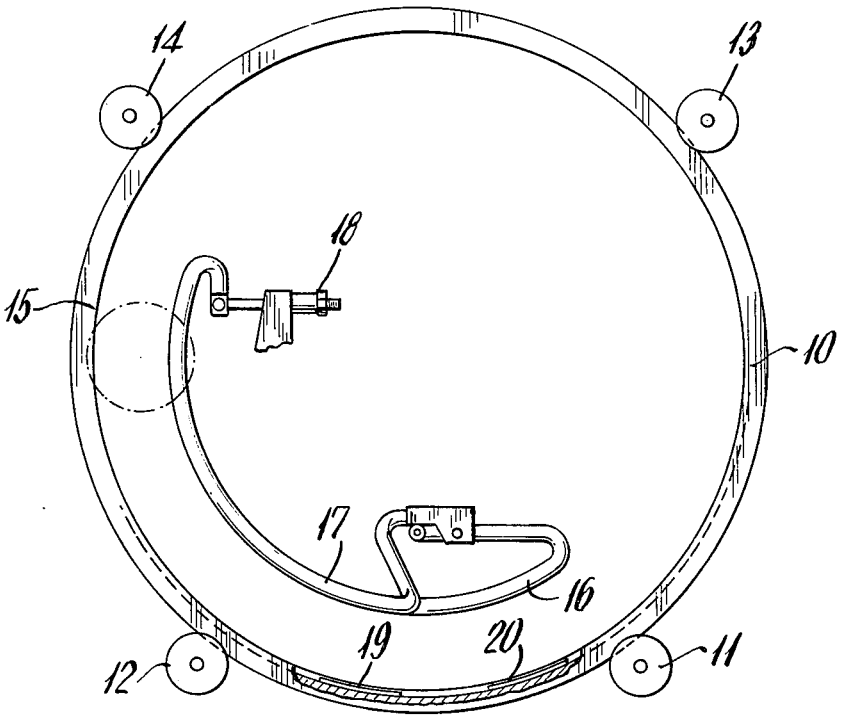
FIG. 1 is a front elevation of part of a ball elevator, the bottom portion being partly in section.

As shown in FIG. 1 of the drawings the ball elevator consist in part of a large steel wheel 10 supported by two flanged guide rollers 11 and 12 at the bottom and two flanged guide rollers 13 and 14 at the top. A motor driven belt (not shown) carried around the outer circumference of the wheel 10 rotates the wheel in a clockwise direction. Concentric with the inside circumference of the steel wheel are ball lift rods which consist of a pair of curved, rubber-covered rods 16 and 17 which are pivoted at the bottom and spring loaded at the top by means of adjusting screw 18. The inside circumference of the wheel 10 is provided with at least one and preferably at least two lifts 19 and 20. Lifts 19 and 20 are adhered permanently by any suitable means to the inside diameter of the wheel 10 and are spaced several inches apart, for example about 5 to 10 inches apart, preferably about 6 to 8 inches apart. As can be seen in FIG. 1, lifts 19 and 20 cover only a minor portion of the inside circumference of the wheel. As the ball reaches the ball elevator it wedges itself between the inner surface of the rotating ball elevator wheel and the ball lift rods and is carried up and deposited on the ball return tracks (not shown). The lifts of the present invention insure that even an oil coated ball is gripped by the wheel and the ball lift rods. As the wheel is rotating rapidly a continuous lift around the inside diameter of the wheel is unnecessary.

Figure 2:
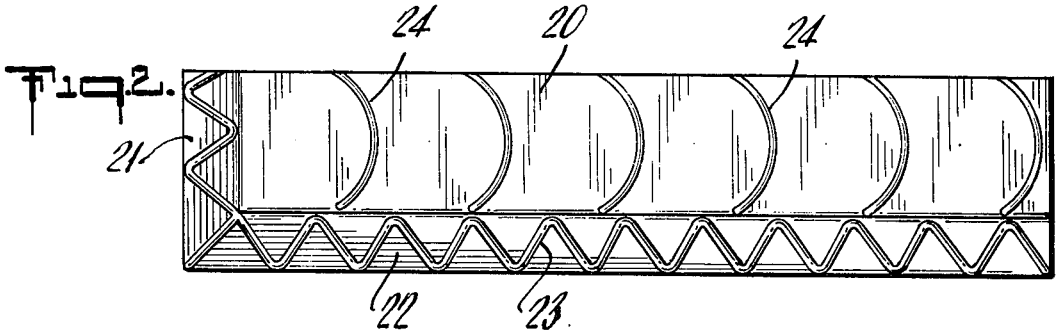
FIG. 2 is a plan view of the lift for the ball elevator.
Figure 3:
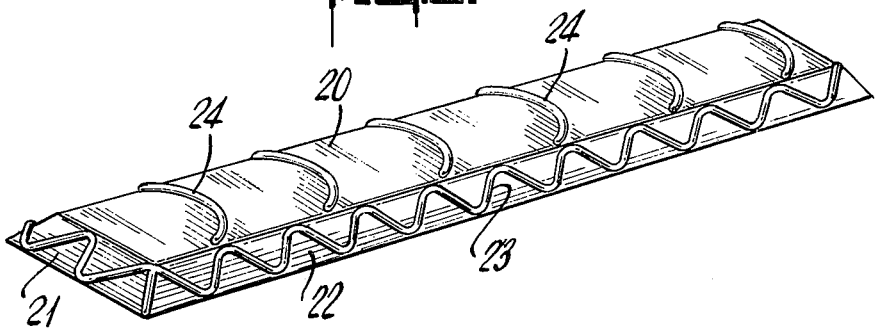
FIG. 3 is a perspective view of the lift for the ball elevator.

FIGS. 2 and 3 show the lift 20 of the present invention separated from wheel 10. The lift 20 has a substantially rectangular shape optionally but preferably with a bevel 21 along one shorter side and a second bevel 22 along one longer side. Bevel 21 is the leading edge of the lift and bevel 22 faces the side of the wheel which first contacts the bowling ball. The bevels 21 and 22 are optionally but preferably provided with raised substantially straight connected diagonal projections 23. The top of the lift 20 is provided optionally but preferably with a plurality of curved projections 24 extending from the bevel to the opposite side.

The lift of the present invention may be formed of natural rubber or its synthetic counterpart, polyisoprene, neoprene, nitrile-butadiene rubber, butyl rubber, chlorinated butyl rubber, and the like. A durometer hardness of about 50 to about 60, typically about 55 is preferred. The lift 20 may be of varying size but lifts about six inches in length and about one and three-eights inches in width and about 1/16 to about ⅛ inch in thickness have been found to yield oustanding results.

What is claimed is:

1. In an automatic pinsetting bowling machine including an elevator wheel for conveying the bowling ball to the ball return track, the improvement wherein the inner circumference of the elevator wheel is provided with a substantially rectangular strip of flexible elastomeric material having a first bevel in the direction of rotation of the elevator wheel and a second bevel facing the open front of the elevator wheel.

2. A strip according to claim 1 wherein each bevel is provided with a plurality of raised diagonals.

3. A strip according to claim 1 wherein the top of the strip is provided with a plurality of arcuate projections which are concave with respect to the direction of rotation of the elevator wheel.

4. In a ball elevator wheel for an automatic pinsetting machine the improvement comprising at least one substantially rectangular strip of flexible elastomeric material adhered to the inner circumference of the wheel, the strip covering only a minor portion of the inner circumference of the ball elevator wheel, the strip being provided with a plurality of projections which are concave with respect to the direction of rotation of the wheel.

5. In a ball elevator wheel for an automatic pinsetting machine the improvement comprising at least two substantially rectangular strips of flexible elastomeric material adhered to the inner circumference of the wheel, the strips covering only a minor portion of the inner circumference of the ball elevator wheel.

6. In a ball elevator wheel for an automatic pinsetting machine the improvement comprising at least one substantially rectangular strip of flexible elastomeric material adhered to the inner circumference of the wheel, the strip having a bevel along two adjacent sides, each bevel being provided with a plurality of raised projections, and the top of the strip having a plurality of projections concave with respect to the direction of rotation of the wheel.

7. A strip according to claim 6 wherein the projections are diagonal with respect to the longitudinal axis of the strip.

8. A ball elevator wheel according to claim 6 wherein 2 spaced apart strips are employed.

* * * * *